US009124024B2

(12) United States Patent
Itsuki et al.

(10) Patent No.: US 9,124,024 B2
(45) Date of Patent: Sep. 1, 2015

(54) CONNECTOR HAVING INNER CONDUCTIVE MEMBER

(71) Applicant: Sumitomo Wiring Systems, Ltd., Yokkaichi, Mie (JP)

(72) Inventors: Kiyotaka Itsuki, Yokkaichi (JP); Hiroyuki Matsuoka, Yokkaichi (JP); Sho Miyazaki, Yokkaichi (JP); Tomokazu Kashiwada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 99 days.

(21) Appl. No.: 13/967,416

(22) Filed: Aug. 15, 2013

(65) Prior Publication Data

US 2014/0051286 A1 Feb. 20, 2014

(30) Foreign Application Priority Data

Aug. 20, 2012 (JP) ..... 2012-181392

(51) Int. Cl.

| | |
|---|---|
| ***H01R 13/40*** | (2006.01) |
| ***H01R 13/533*** | (2006.01) |
| ***H01R 24/20*** | (2011.01) |
| ***H01R 13/447*** | (2006.01) |
| ***H01R 13/52*** | (2006.01) |
| *H01R 103/00* | (2006.01) |
| *H01R 13/631* | (2006.01) |
| *H01R 13/6581* | (2011.01) |

(52) U.S. Cl.

CPC ..... *H01R 13/533* (2013.01); *H01R 13/40* (2013.01); *H01R 13/447* (2013.01); *H01R 13/5202* (2013.01); *H01R 13/5219* (2013.01); *H01R 24/20* (2013.01); *H01R 13/6315* (2013.01); *H01R 13/6581* (2013.01); *H01R 2103/00* (2013.01)

(58) Field of Classification Search

USPC ..... 439/587, 452, 456, 460, 468, 470, 660, 439/607.01, 607.08, 607.24, 382, 345.485, 439/588, 271, 583, 352, 188; 361/816; 174/84 R

See application file for complete search history.

(56) References Cited

U.S. PATENT DOCUMENTS

| | | | | |
|---|---|---|---|---|
| 3,860,315 | A * | 1/1975 | Tetreault et al. | 439/186 |
| 2002/0155757 | A1* | 10/2002 | Yoshioka | 439/607 |
| 2004/0266270 | A1* | 12/2004 | Miyazaki | 439/660 |
| 2010/0255728 | A1* | 10/2010 | Matsuoka et al. | 439/607.55 |
| 2013/0316573 | A1* | 11/2013 | Uno et al. | 439/573 |

FOREIGN PATENT DOCUMENTS

| | | |
|---|---|---|
| JP | 2000-277217 | 10/2000 |

* cited by examiner

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A connector (10) includes a housing (20) connectable to a mating housing of the mating connector. A female terminal (52) is held in the housing (20) and includes a terminal connecting portion (52A) to be connected to a mating terminal provided in the mating connector and a barrel (52B) connected to the terminal connecting portion (52A). A flexible outer wire (70) is pulled out to outside from the interior of the housing (20). An inner conductive member (50) connects the barrel (52B) and the outer wire (70) in the housing (20) and includes an intermediate portion (53C) formed by bending a metal plate material substantially at a right angle. The intermediate portion (53C) is fixed to the housing (20).

20 Claims, 12 Drawing Sheets

CONNECTOR HAVING INNER CONDUCTIVE MEMBER

BACKGROUND

1. Field of the Invention

The invention relates to a connector.

2. Description of the Related Art

Japanese Unexamined Patent Publication No. 2000-277217 discloses a connector that prevents trouble during a connection due to a dimensional accuracy error or the like. More particularly, a leaf spring of a spring washer is arranged between a connector main body and a bottom plate and is deflected when a mating connector is inserted. Thus, the connector main body pivots according to the position of the mating connector.

A conductive member is pulled out from the connector main body of Japanese Unexamined Patent Publication No. 2000-277217 to a body side and is connected to the body. However, vibration from the body is transmitted to a terminal fitting via the conductive member, and may cause trouble where the terminal fitting is connected to a mating terminal fitting. A flexible wire can be used as the conductive member and can be fixed to the connector main body to absorb vibration from the body. However, a large diameter wire requires a large bending radius to bend the wire at a right angle in a corner of the connector main body and to fix the wire to the connector main body. This is disadvantageous in miniaturizing the connector.

The invention was completed in view of the above situation and an object thereof is to miniaturize a connector while absorbing vibration from a body side.

SUMMARY OF THE INVENTION

The invention relates to a connector with a housing that is connectable to a mating housing of a mating connector. At least one terminal is held in the housing and includes a terminal connecting portion and a conductor connecting portion. The terminal connecting portion is to be connected to a mating terminal in the mating connector. A flexible outer wire is pulled out to outside from the interior of the housing. An inner conductive member connects the conductor connecting portion and the outer wire in the housing and includes a bent intermediate portion formed by bending a conductive plate material. The intermediate portion is fixed to the housing. Vibration can be blocked by fixing the inner conductive member to the housing while absorbing the vibration by the flexible outer wire.

The bent intermediate portion is formed by bending a conductive plate material substantially at a right angle. Formation of the intermediate portion of the inner conductive member of the metal plate material permits a small bending radius and enables the connector to be miniaturized.

The inner conductive member may include an inner wire and an L-shaped intermediate terminal connected to the inner wire to form the intermediate portion. The intermediate terminal may include an inner wire fixing portion arranged at one side of the intermediate portion to be fixed to the inner wire and an outer wire fixing portion arranged at the other side to be fixed to the outer wire. The intermediate portion can be bent into an L-shape. Thus, the structure of the intermediate terminal does not become complicated. For example, two round terminals and a fastening member are needed to fasten a round terminal connected to the inner wire to a round terminal connected to the outer wire together. However, according to the invention, it is sufficient to prepare only the L-shaped intermediate terminal, which leads to a reduction in the number of components.

A part of the intermediate portion to be fixed to the housing may be flush with the outer wire fixing portion.

The intermediate portion may be fastened to the housing by a screw. According to this configuration, the intermediate portion is arranged at the side of the outer wire crimping portion susceptible to vibration. Thus, the impact of vibration is blocked easily. Further, a fastening direction by the screw is perpendicular to a vibration transmission direction and the impact of vibration is blocked more easily.

The intermediate portion may be press-fitted into the housing. Thus, the intermediate portion can be fixed to the housing by an easy press-fit method. Furthermore, it is not necessary to provide a terminal block with a nut press-fit into the housing and the housing can be miniaturized.

The housing may be covered at least partly by a shield shell made of an electrically conductive plate or sheet material. The shield shell may comprise first and second members to be assembled together. The second member may be formed with at least one mounting portion to be mounted and fixed to the shield case.

At least one mounting groove may be provided on a wire pullout portion from which the outer wire is pulled out from the housing and at least one seal ring be mounted in the mounting groove.

An operation hole may be formed in the housing in correspondence with the terminal fixing portion and a cover may be mounted to the operation hole.

The cover may include a seal ring that closely contacts the inner peripheral surface of the operation hole to seal the interior of the housing.

Two intermediate terminals may be provided and may be accommodated in corresponding accommodation spaces. Adjacent intermediate terminals may be partitioned by at least one partition wall partitioning a pair of adjacent accommodation spaces.

The intermediate portion may be fixed to the housing in a fastening direction that is substantially perpendicular to a vibration transmission direction.

These and other features and advantages of the invention will become more apparent upon reading the following detailed description of preferred embodiments and accompanying drawings. It should be understood that even though embodiments are described separately, single features may be combined to additional embodiments.

DETAILED DESCRIPTION OF THE PREFERRED EMBODIMENTS

A first embodiment of the invention is described with reference to FIGS. 1 to 4. A connector 10 of this embodiment is to be mounted on a shield case (not shown) of a device (e.g. inverter, motor or the like of a vehicle such as a hybrid vehicle or an electric vehicle). A device-side connector is arranged at a position substantially facing the connector 10 in a connecting direction in the shield case is connectable to the connector 10. Note that a vertical direction VD is based on that of FIG. 1 in the following description. Further, forward and backward directions FBD are based on lateral directions of FIG. 2. A leftward direction (connecting direction CD to the device-side connector) is referred to as a forward direction and a rightward direction (separating direction SD from the device-side connector) is referred to as a backward direction.

Figure 4:
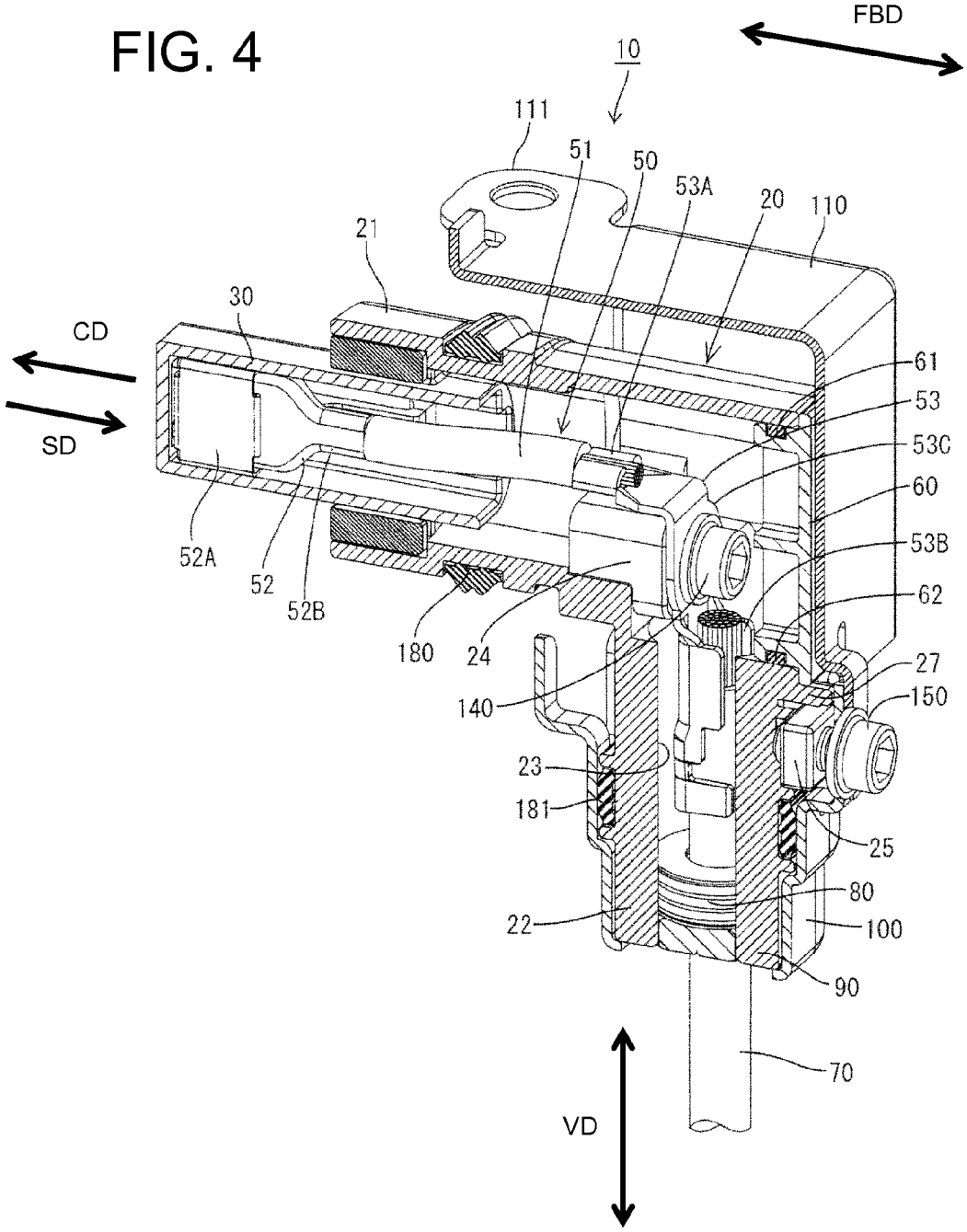
FIG. 4 is a perspective view in section of the internal structure of the connector when viewed obliquely from above.
Figure 5:
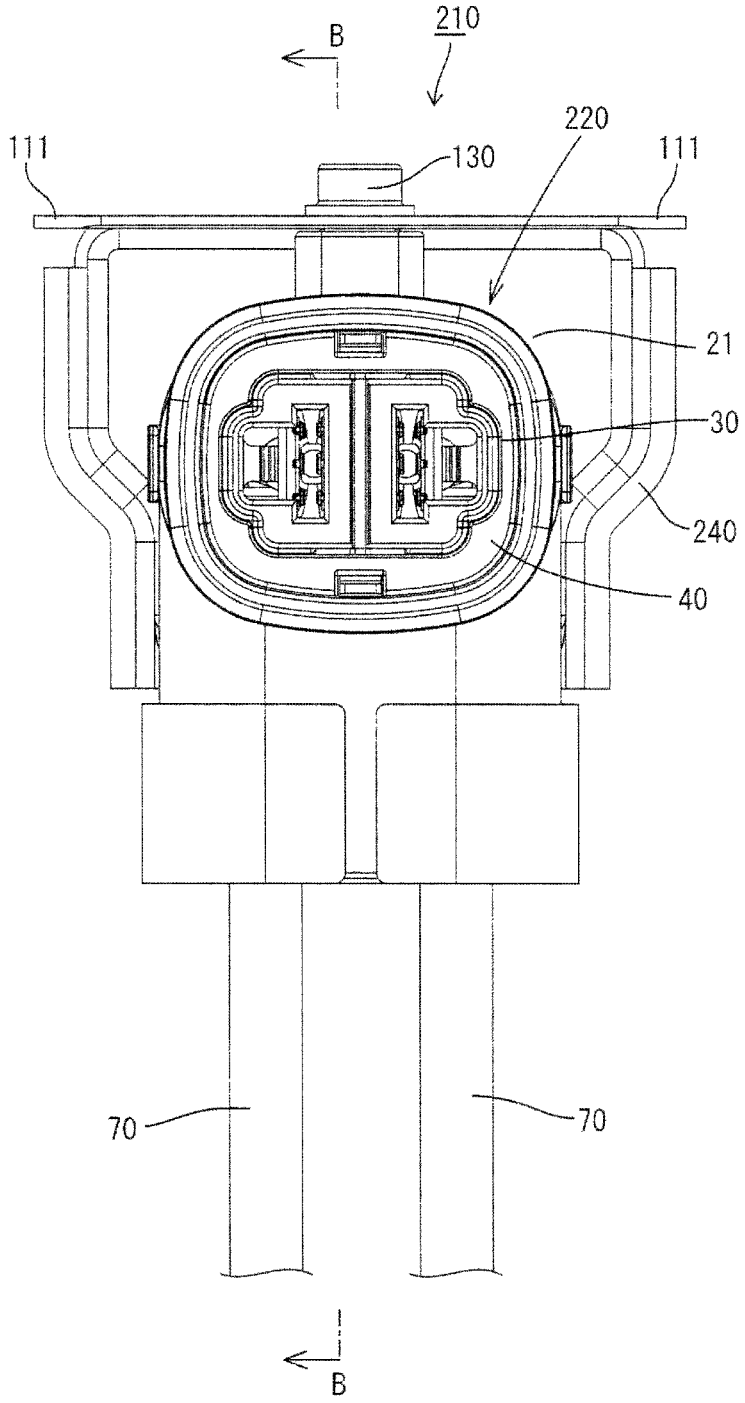
FIG. 5 is a front view of a connector of a second embodiment.
Figure 6:
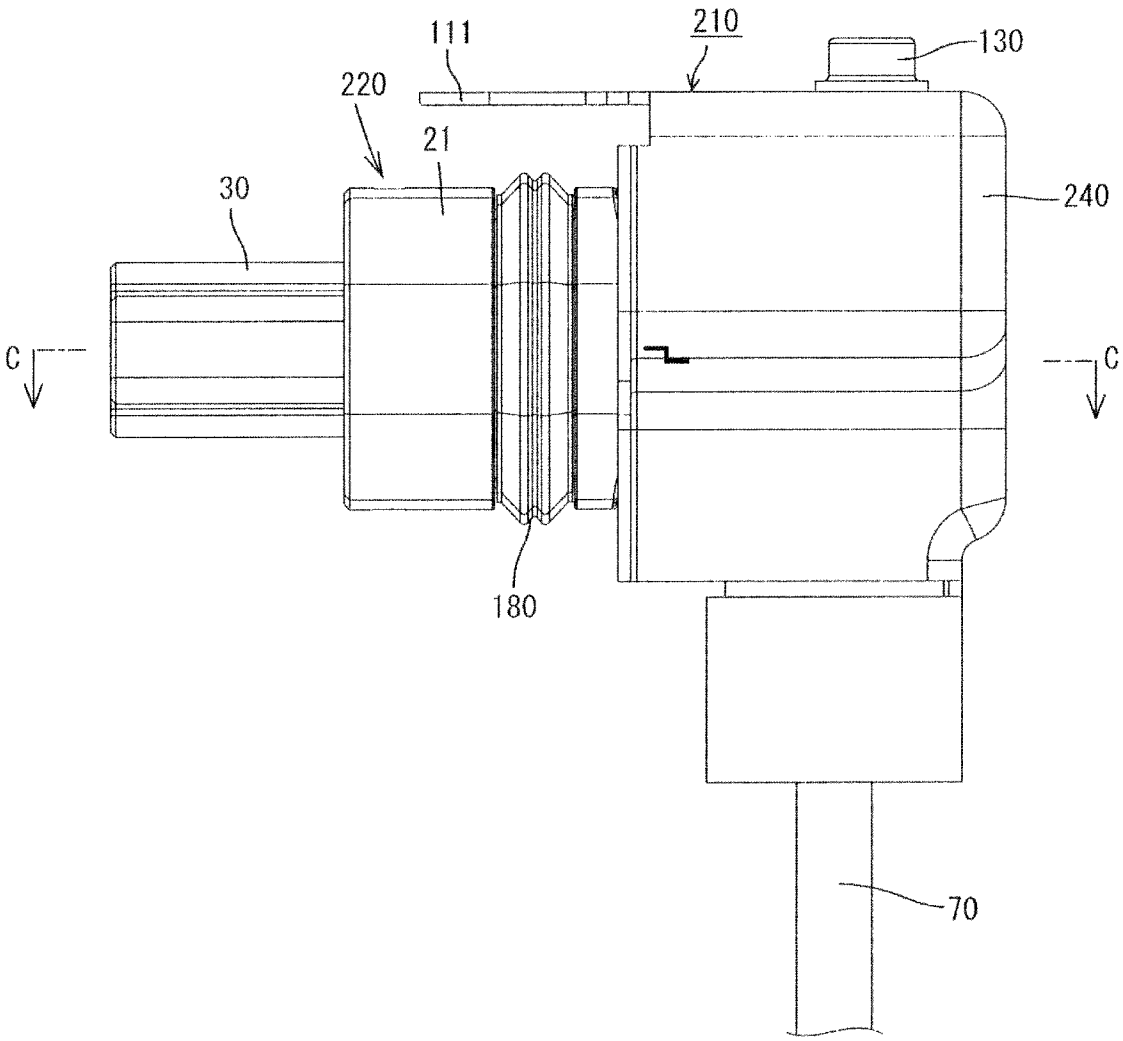
FIG. 6 is a right side view of the connector.

As shown in FIG. 4, the connector 10 includes a housing 20, inner conductive members 50, a cover 60, outer wires 70, resilient or rubber plugs 80, a plug presser 90, a lower member 100, an upper member 110, fixing screws 140, and a coupling screw 150. A terminal accommodating portion 30 is provided in the housing 20 and can fit into the device-side connector.

Two inner conductive members 50 are provided substantially side by side in the lateral direction, and the adjacent inner conductive members 50 are to be insulated from each other in the terminal accommodating portion 30. Each inner conductive member 50 includes a flexible inner wire 51 extending in substantially forward and backward directions FBD, a female terminal 52 connected to a front end part of the inner wire 51, and an intermediate terminal 53 connected to a rear end part of the inner wire 51. The female terminal 52 is to be retained in the terminal accommodating portion 30.

The female terminal 52 includes a rectangular tubular terminal connecting portion 52A to be connected to a male terminal (not shown) in the device-side connector and a wire connection barrel 52B behind the terminal connecting portion 52A and to be crimped, folded or bent into electrical connection with a front end part of the inner wire 51.

The intermediate terminal 53 is bent at an angle and preferably a substantially right angle to define an L-shape and includes an inner wire crimping portion 53A to be crimped into electrical connection with the rear end part of the inner wire 51, an outer wire crimping portion 53B to be crimped into electrical connection to an upper or distal end part of the vertically extending outer wire 70, and an intermediate portion 53C connecting the inner and outer wire crimping portions 53A, 53B. This intermediate terminal 53 is formed into an L-shape by bending the intermediate portion 53C at least at one position, preferably at a substantially right angle.

The inner wire 51 is crimped to the female terminal 52 and the intermediate terminal 53 in this embodiment. However, the inner wire 51 may be connected to the female terminal 52 and the intermediate terminal 53 by various known connection means, such as brazing, soldering and/or welding. Similarly, the connection of the intermediate terminal 53 and the outer wire 70 is not limited to crimp connection described above and may be made by various other known connection methods such as welding.

The outer wire 70 has a core made up of a plurality of conductive or metal strands covered with an insulation coating. The outer wire 70 is flexible and deflectable in a direction intersecting with an axial direction. Thus, a part of vibration transmitted from a body is absorbed by the deflection of the outer wire 70 and vibration that cannot be absorbed by the outer wire 70 is transmitted to the intermediate terminal 53.

Figure 1:
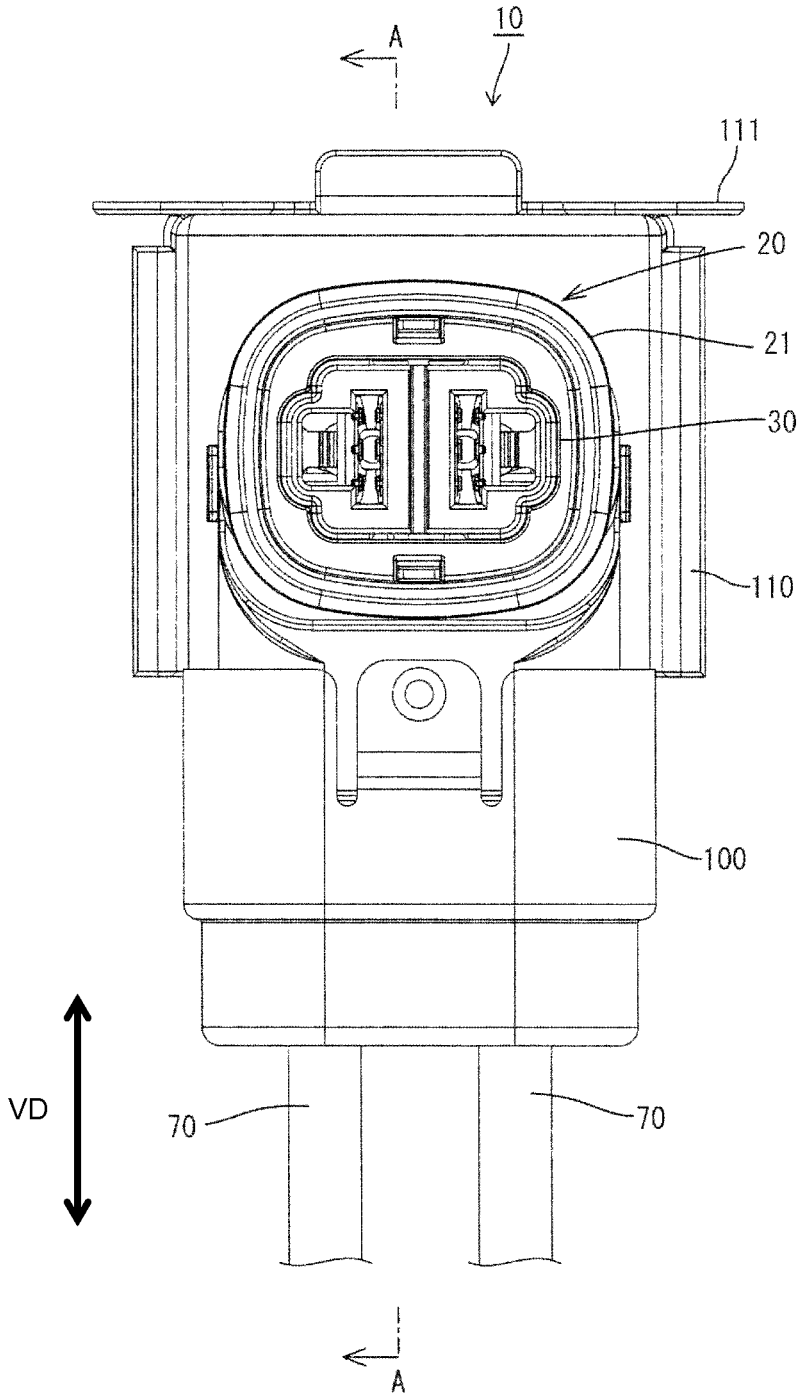
FIG. 1 is a front view of a connector of a first embodiment.
Figure 2:
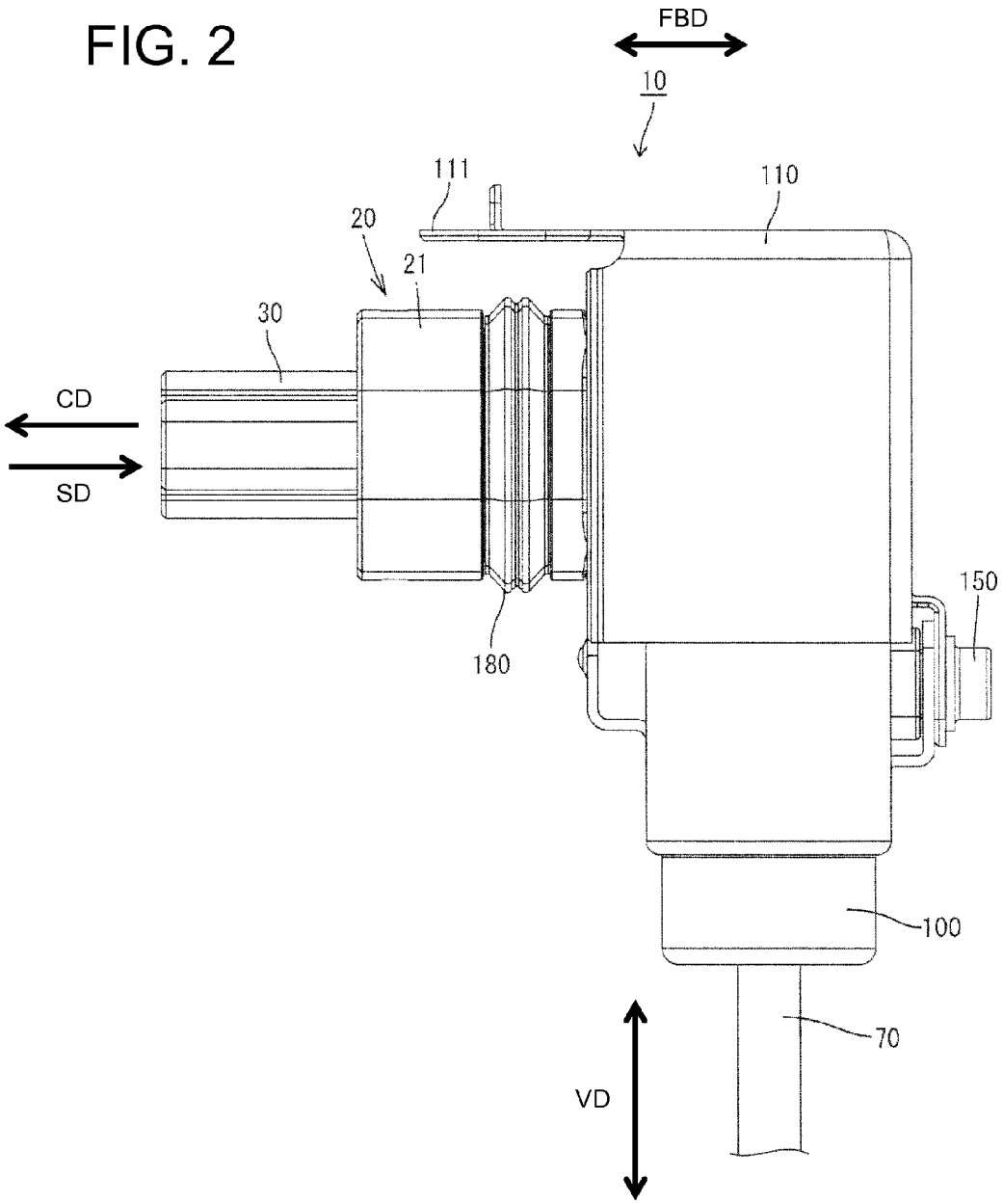
FIG. 2 is a right side view of the connector.
Figure 3:
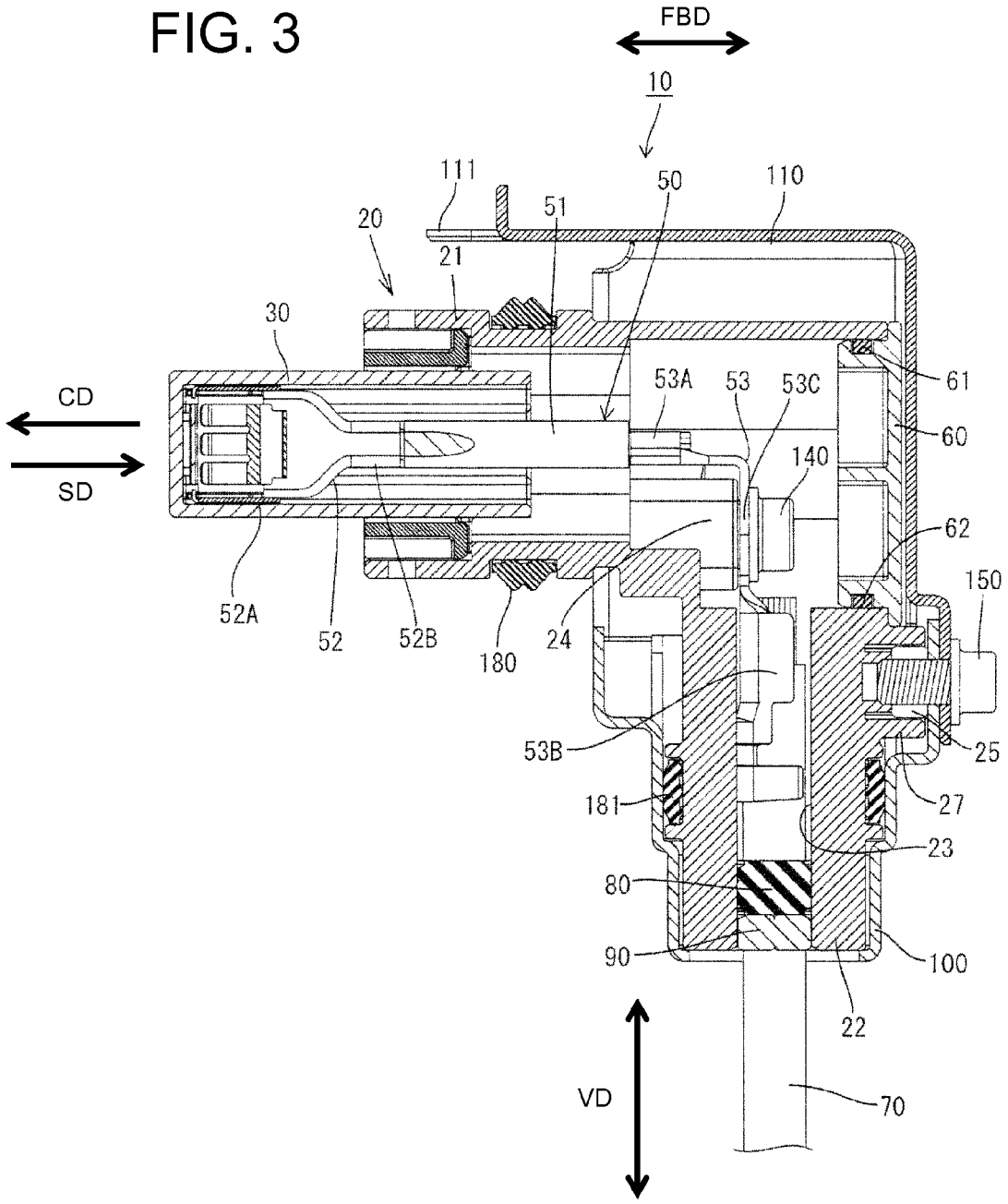
FIG. 3 is a section along A-A of FIG. 1.

The housing 20 is made e.g. of synthetic resin and has a substantially L-shape, with a fitting 21 and a wire pullout portion 22 at opposite ends, as shown in FIG. 3. The fitting 20 is configured to fit into a case-side opening of the shield case, and a front portion of the terminal accommodating portion 30 projects forward in the connection direction CD from the front surface of the fitting 21. The wire pullout portion 22 includes two independent accommodation spaces 23 capable of individually accommodating the two outer wires 70, which are pulled out laterally or down from the wire pullout portion 22. The plugs 80 and the plug presser 90 are accommodated in the wire pullout portion 22.

The plugs 80 are seals made of a resilient material such as rubber, and are sandwiched over the entire circumference between the outer peripheral surfaces of the outer wires 70 and the inner peripheral surface of the wire pullout portion 22 for individually making the respective outer wires 70 fluid- or watertight. Further, the plug presser 90 is to be retained in the wire pullout portion 22. In this way, the plugs 80 are held in the wire pullout portion 22 by the plug presser 90 while sealing the accommodation spaces 23 of the wire pullout portion 22.

The housing 20 is at least partly covered by a shield shell made of an electrically conductive metal plate or sheet, such as iron plate, aluminum or aluminum alloy and is formed by assembling a lower member 100 and an upper member 110 with each other. The lower member 100 mainly covers the wire pullout portion 22 and the upper member 110 mainly covers the fitting 21. Further, the upper member 110 is formed with at least one mounting portion 111 to be mounted and fixed to the shield case. As shown in FIG. 3, a shell coupling 27 is formed on the rear surface of the housing 20 and at least one fixing nut 25 is press-fit therein.

The lower member 100 and the upper member 110 are arranged one over the other on the shell coupling 27, and are coupled in an electrically connected state as the shield shell. The coupling screw 150 is inserted through screw insertion holes formed in the members 100, 110 and tightening into the respective fixing nuts 25 to fix the shield shell to the housing 20.

At least one mounting groove is provided circumferentially on the outer peripheral surface of the wire pullout portion 22 for receiving at least one seal ring 180. This seal ring 180 is to be sandwiched between the bottom surface of the mounting groove and the inner surface of the case-side opening over the entire circumference when the fitting 21 is fit in the case-side opening to seal the interior of the shield case.

At least one mounting groove is provided circumferentially on the outer peripheral surface of the wire pullout portion 22 for receiving at least one seal ring 181. This seal ring 181 is to be sandwiched between the bottom surface of the mounting groove and the inner surface of the lower member 100 over the entire circumference when the lower member 100 of the shield shell is fit externally to the wire pullout portion 22 to hold the interior of the lower member 100 in a sealed state.

A terminal fixing portion 24 is arranged in a substantially right-angled corner of the housing 20 that couples the fitting 21 and the wire pullout portion 22. Nuts (not shown) are press-fit into the terminal fixing portion 24. The intermediate portions 53C of the intermediate terminals 53 are arranged on the nuts and the fixing screws 140 are inserted through respective round holes formed in the intermediate portions 53C and tightened into the nuts for fixing the intermediate terminals 53 to the terminal fixing portion 24. In this way, vibration transmitted from the outer wires 70 are blocked by the terminal fixing portion 24 built in the housing 20. Even if all the vibration cannot be blocked by the housing 20, the inner wires 51 located before the terminal fixing portion 24 are deflected to absorb all the remaining vibration and the like so that contact portions of the male terminals and the female terminals 52 are not affected.

The intermediate portions 53C of the intermediate terminals 53 are arranged adjacent to the corner of the terminal fixing portion 24. If it is attempted to bend the outer wire 70 at a right angle in the corner of the terminal fixing portion 24, a bending angle of the outer wire 70 becomes larger and the outer wire 70 can no longer be accommodated in the housing 20. However, the intermediate portion 53C is made of a conductive metal plate material and has a substantially right-angled bend. Thus, the bending radius of the intermediate portion 53C can be made as small as possible and can contribute to the miniaturization of the connector 10.

As shown in FIG. 3, an operation hole 62 is formed substantially behind the terminal fixing portion 24 in the housing 20 and the cover 60 is mounted thereto. The cover 60 includes a seal ring 61 that closely contacts the inner peripheral surface of the operation hole 62 to seal the interior of the housing 20. The fixing screws 140 are exposed to outside through the operation hole 62. Thus, the fixing screws 140 can be tightened by easily inserting, a tool such as a hexagonal wrench, through the operation hole 62. After an operation is finished, the cover 60 is mounted to the operation hole 62 to seal the interior of the housing 20.

The two outer wires 70 are inserted through the lower member 100 and then are inserted into the housing 20 through the operation hole 62 by being inserted into the accommodation spaces 23 of the housing 20 from the wire pullout portion 22. Further, the female terminals 52 are crimped to first ends of inner wires 51 and the intermediate terminals 53 crimped to the second ends to form the inner conductive members 50. Further, the outer wires 70 are crimped to the outer wire crimping portions of the intermediate terminals 53. The female terminals 52 then are inserted into the housing 20 through the operation hole 62 and into the terminal accommodating portion 30 from behind. Locking lances cantilevered in the terminal accommodating portion 30 retain the female terminals 52 that have been inserted to proper positions. The intermediate terminals 53 are inserted into the housing 20 through the operation hole 62 so that the intermediate portions 53C are arranged along the corner of the terminal fixing portion 24. The fixing screws 140 then are inserted through the round holes of the intermediate portions 53C and tightened into screw holes of the nuts so that the intermediate terminals 53 are fixed to the terminal fixing portion 24.

Rubber plugs 80 already are fit on the respective outer wires 70 and are fit through a lower end opening of the lower member 100 and the plug presser 90 is mounted below the plugs 80 to hold the plugs 80. Thereafter, the cover 60 is mounted to close the operation hole 62 and the interior of the housing 20 is sealed by the seal ring 61.

The lower member 100 having the outer wires 70 inserted therethrough is mounted externally on the wire pullout portion 22 of the housing 20. Further, the upper member 110 is mounted from the rear side of the housing 20. The respective members 100, 110 then are placed one over the other on the shell coupling portion 27 and the coupling screw 150 is tightened into the fixing nut 25 to fix the respective members 100, 110 to the housing 20. In this way, the members 100, 110 are united to form the shield shell and the housing 20 at is covered by this shield shell.

As described above, vibration can be absorbed by fixing the inner conductive members 50 to the housing 20 while absorbing the vibration by the flexible outer wires 70. Further, since the intermediate portions 53C of the inner conductive members 50 are made of the conductive metal plate material, the bending radius can be made smaller and the connector 10 can be miniaturized.

The inner conductive member 50 may be composed of the inner wire 51 and the intermediate terminal 53 connected to this inner wire 51 to form the intermediate portion 53C, and this intermediate terminal 53 may include the inner wire crimping portion 53A arranged at one side of the intermediate portion 53C to be crimped to the inner wire 51 and the outer wire crimping portion 53B arranged at the other side to be crimped to the outer wire 70.

The intermediate portion 53C can be formed into a bent L-shape. For example, when fastening a round terminal connected to the inner wire 51 and a round terminal connected to the outer wire 70 together, two terminals connected to the respective wires 51, 70 and a fastening member are necessary. However, according to the above configuration, it is sufficient to prepare only the bent L-shaped intermediate terminal 53, thereby reducing the number of components. Further, there is no need to fasten the pair of round terminals together by the terminal fixing portion 24, and it is sufficient to insert the fixing screw 140 through the round hole of the intermediate portion 53C and tighten it into the terminal fixing portion 24. Thus, operability is good.

A part of the intermediate portion 53C to be fixed to the housing 20 may be substantially flush with the outer wire crimping portion 53B and fastened to the housing 20 by the fixing screw 140. According to such a configuration, the intermediate portion 53C is arranged at the side of the outer wire crimping portion 53B susceptible to vibration. Thus, the impact of vibration is blocked easily. Further, a fastening direction by the fixing screw 140 is substantially perpendicular to a vibration transmission direction and, hence, the impact of vibration is blocked more easily.

A second embodiment of the invention is described with reference to FIGS. 5 to 12. This embodiment differs from the first embodiment in that intermediate terminals are fixed to a housing by being press-fit. Configurations, functions and effects similar or common to the first embodiment are not described and the same reference signs as in the first embodiment are used.

Figure 8:
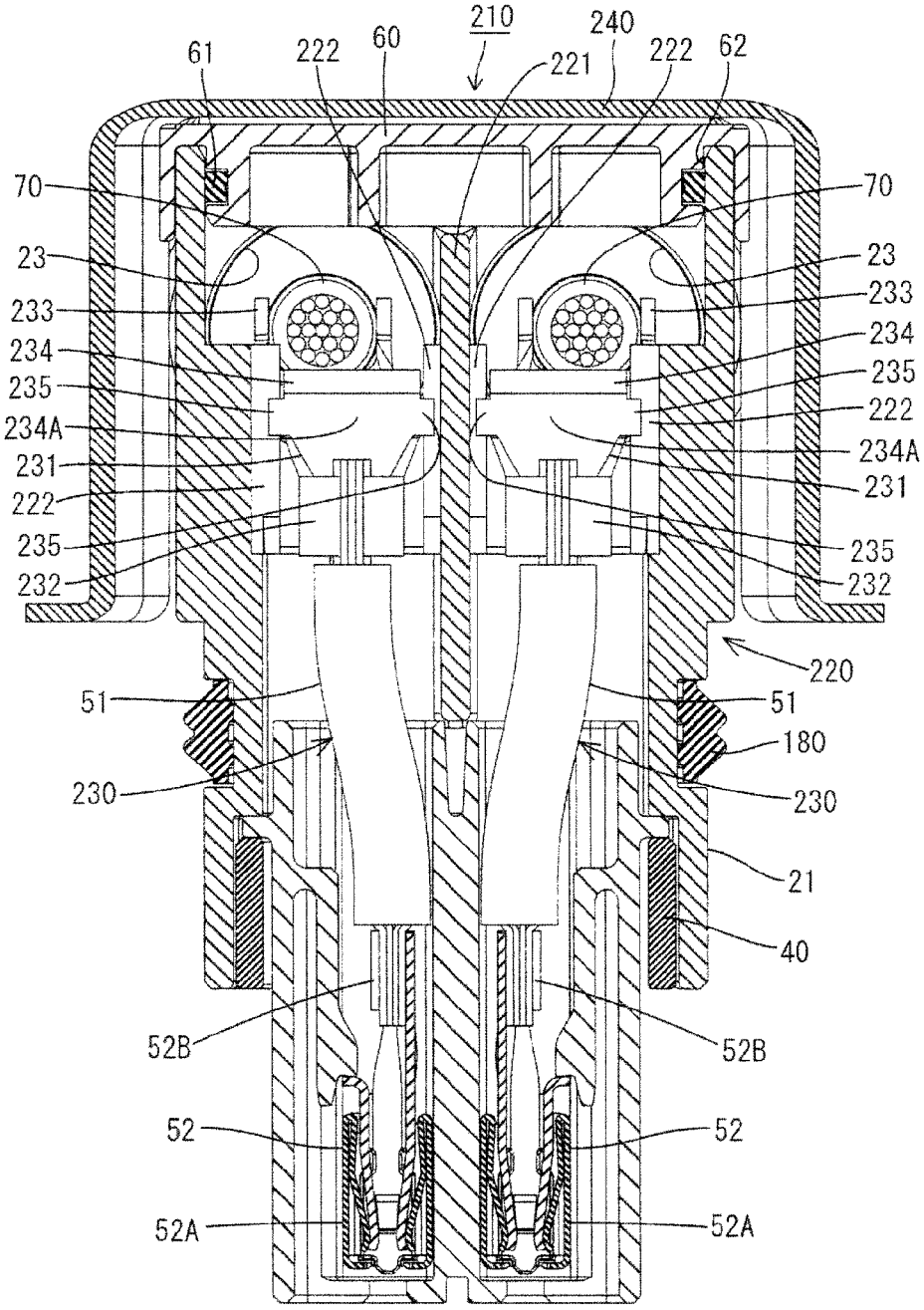
FIG. 8 is a section along C-C of FIG. 6.
Figure 9:
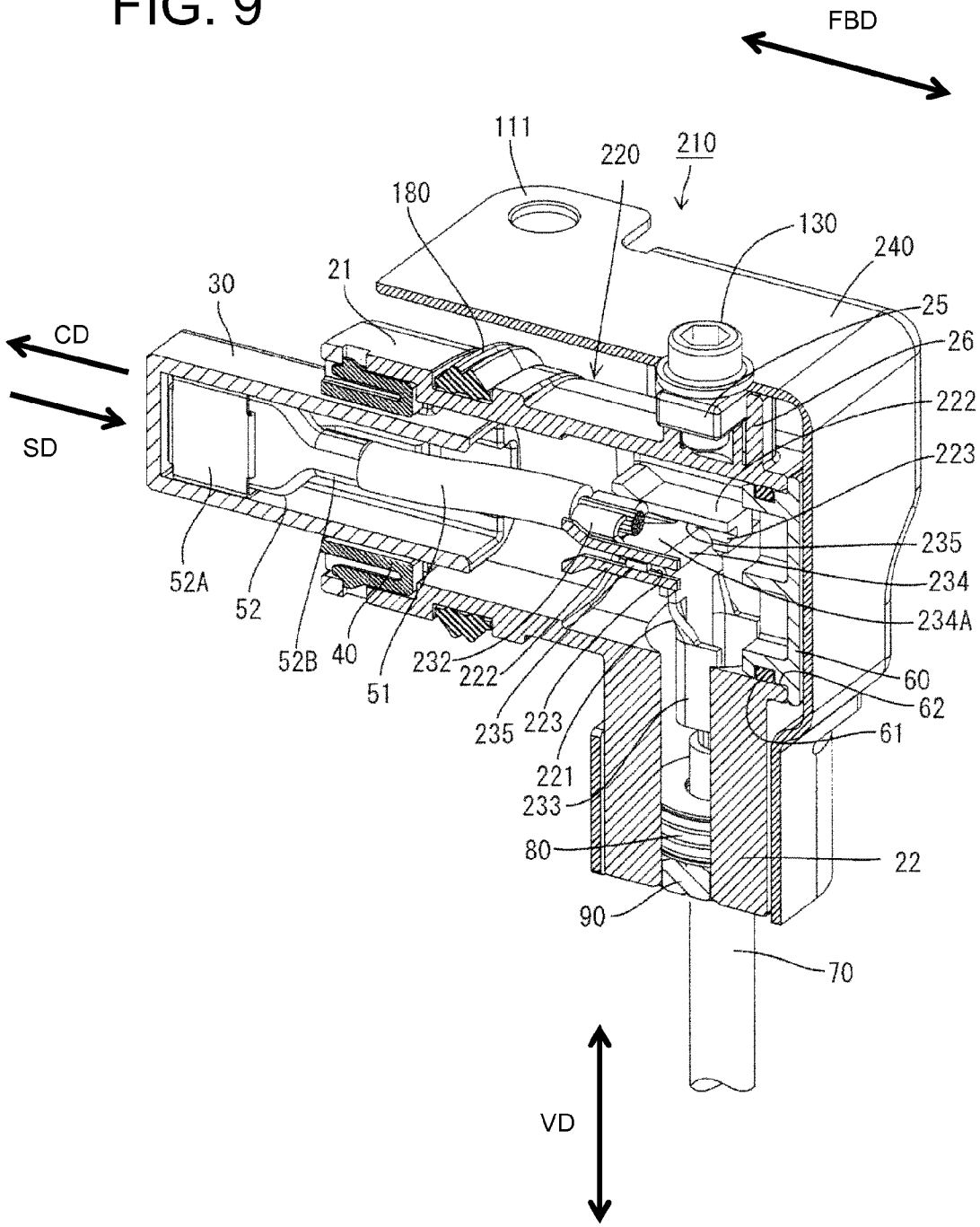
FIG. 9 is a perspective view in section of the internal structure of the connector when viewed obliquely from above.
Figure 10:
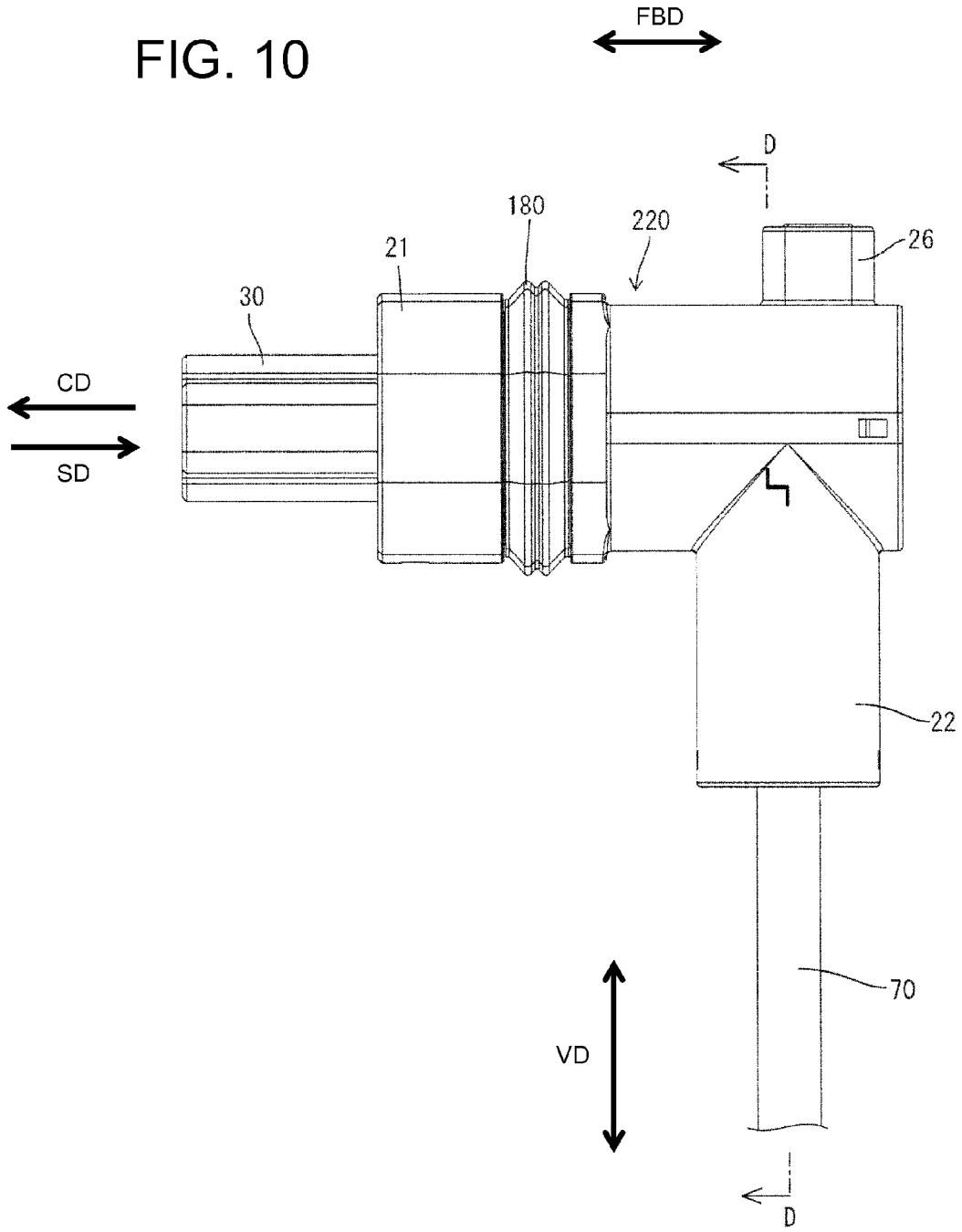
FIG. 10 is a right side view of the connector in a state where a shield shell is removed.

As shown in FIG. 9, a connector 210 includes a housing 220, inner conductive members 230, a cover 60, outer wires 70, resilient or rubber plugs 80, a plug presser 90, fixing screws 140, a coupling screw 150 and a shield shell 240. A terminal accommodating portion 30 is provided in the housing 220 and can fit into a device-side connector. The terminal accommodating portion 30 is retained by a retainer 40 so as not to come out forward, as shown in FIG. 8.

Figure 7:
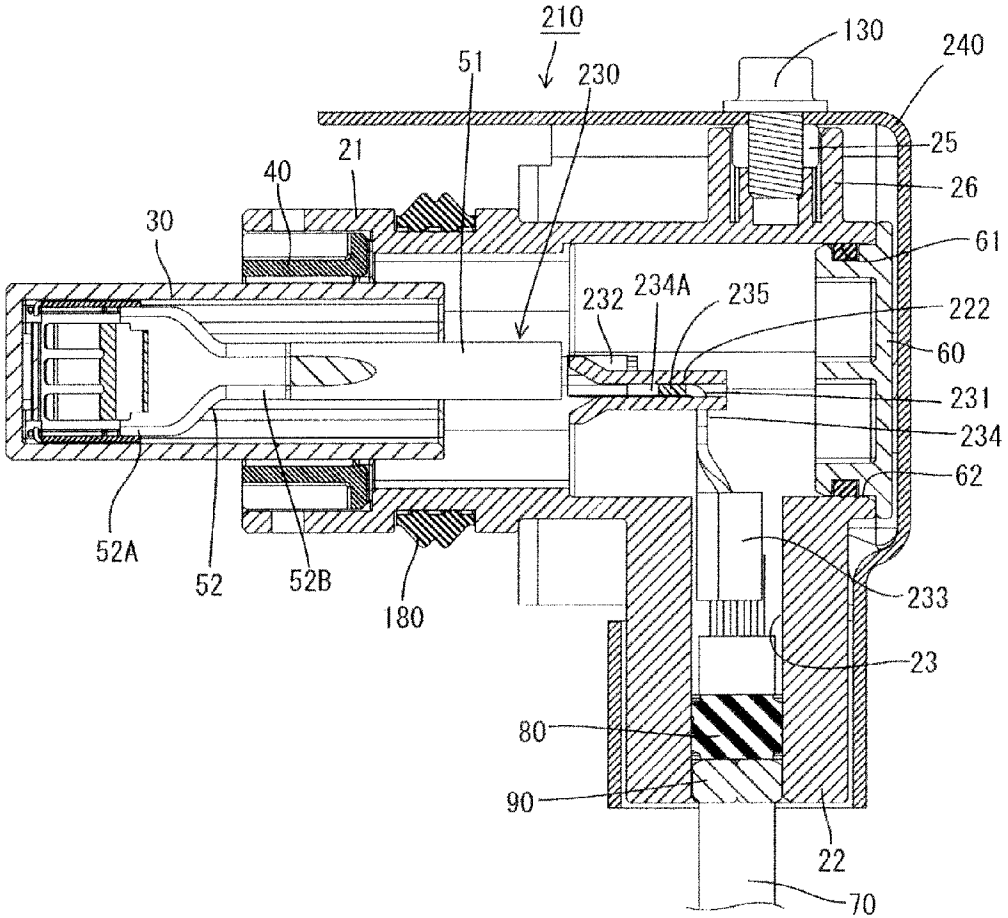
FIG. 7 is a section along B-B of FIG. 5.

As shown in FIG. 7, the shield shell 240 is an assembly of the lower member 100 and the upper member 110 as in the first embodiment and covers the entire housing 220. Note that, in this embodiment, no seal ring 181 is provided between a wire pullout portion 22 and the shield shell 240.

A shell fixing portion 26 is formed on the upper surface of the housing 220 and a fixing nut 25 is press-fit therein. The shield shell 240 is placed on the shell fixing portion 26 and is fixed to the housing 220 by inserting a mounting screw 130 through a screw insertion hole formed in the upper surface of the shield shell 240 and tightening it into the fixing nut 25.

Note that, the shell coupling portion 27 of the first embodiment particularly is not provided in this embodiment.

The inner conductive member 230 of this embodiment includes a flexible inner wire 51 that extends in forward and backward directions FBD, a female terminal 52 connected to a front end part of the inner wire 51, and an intermediate terminal 231 connected to a rear end part of the inner wire 51. A locking lance 35 is cantilevered in the terminal accommodating portion 30 and retains the properly inserted female terminal 52, as shown in FIG. 8. Two inner conductive members 230 are provided side by side in the lateral direction, and are accommodated in the terminal accommodating portion 30 in a state insulated from each other.

Two side by side intermediate terminals 231 are accommodated in corresponding accommodation spaces 23 and are partitioned by a partition wall 221 that partitions the adjacent accommodation spaces 23. In this way, a creepage distance (insulating property) between the adjacent intermediate terminals 231 is ensured.

As shown in FIG. 9, the intermediate terminal 231 is bent to have an L-shape and includes an inner wire crimping portion 232 to be crimped to a rear end part of the inner wire 51, an outer wire crimping portion 233 to be crimped to an upper or distal end part of the substantially vertically extending outer wire 70, and an intermediate portion 234 connecting the inner and outer wire crimping portions 232, 233. The intermediate terminal 231 is formed into an L-shape by bending the intermediate portion 234 at a substantially right angle. Two press-fit projections 235 protrude from left and right side edges of a horizontal portion 234A of the intermediate portion 234 and are substantially flush with the inner wire crimping portion 232.

Figure 11:
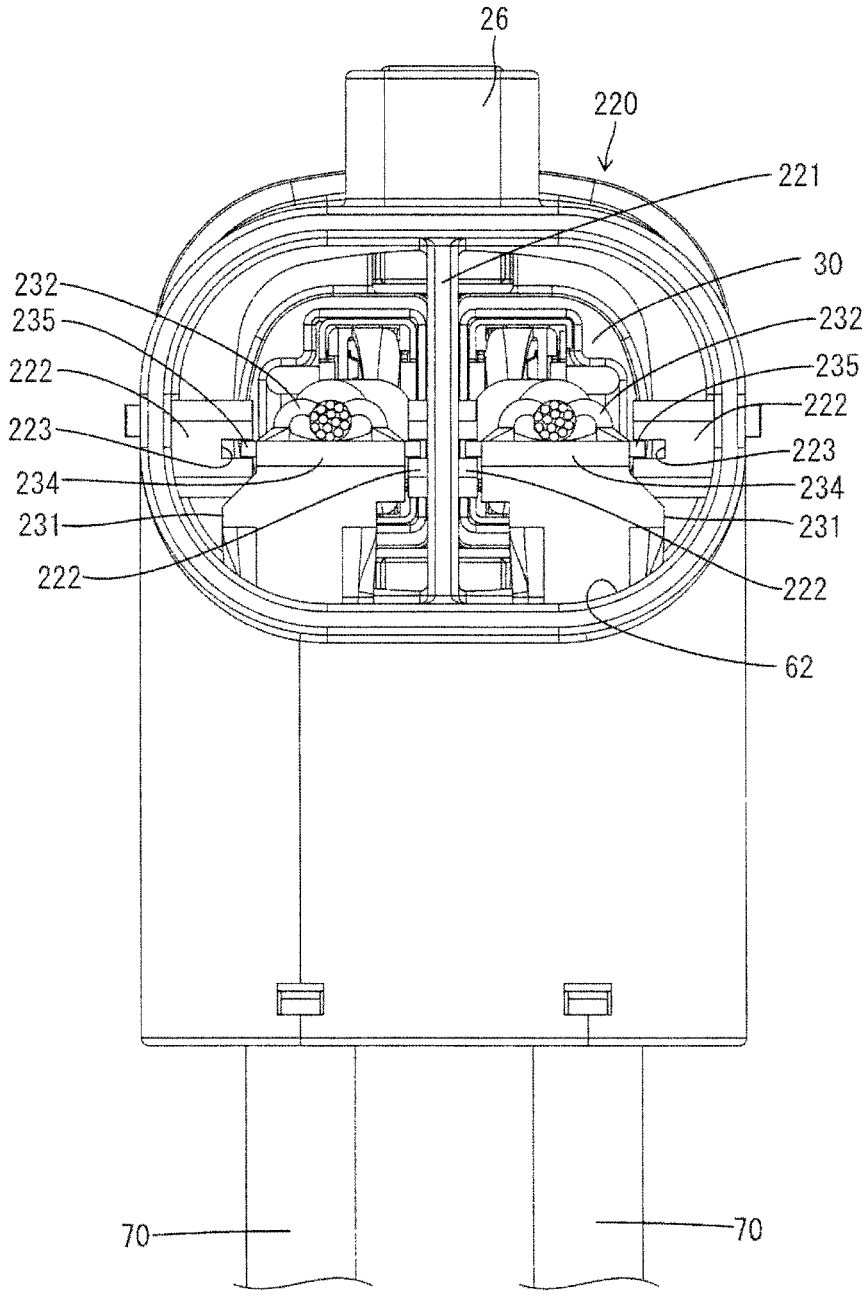
FIG. 11 is a rear view viewed from behind showing a state where a cover of the connector of FIG. 10 is removed.
Figure 12:
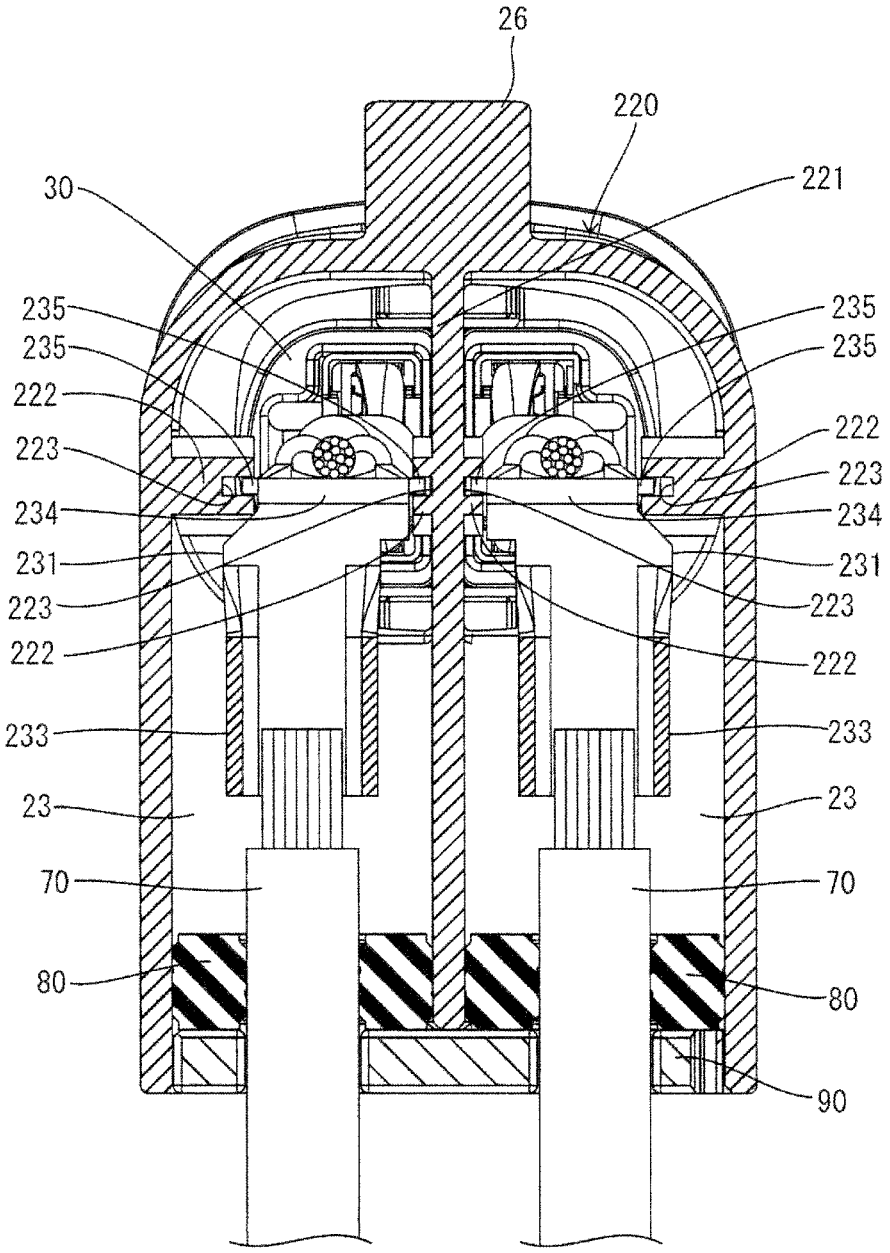
FIG. 12 is a section along D-D of FIG. 10.

As shown in FIGS. 11 and 12, two terminal fixing portions 222 are provided on side walls at substantially opposite sides of the intermediate terminal 231 in the housing 220. Press-fit recesses 223 are formed on the terminal fixing portions 222 into which the respective press-fit projections 235 are to be press-fit from behind. The intermediate terminals 231 are fixed to the housing 220 when the respective press-fit projections 235 are press-fit into the respective press-fit recesses 223.

In this way, vibrations transmitted from the outer wires 70 are blocked by the terminal fixing portions 222 built in or mounted to the housing 220. Particularly, a press-fit direction of each press-fit projection is substantially perpendicular to a vibration transmission direction and, hence, the impact of vibration is blocked more easily. Even if all of the vibration cannot be blocked by the housing 220, the inner wires 51 located before the terminal fixing portions 222 absorb all the remaining vibration so that contact portions of male terminals and the female terminals 52 are not affected.

As described above, in this embodiment, the intermediate terminals 231 can be fixed to the housing 220 by an easy press-fit method. Thus, it is not necessary to provide a terminal block such as by press-fitting nuts into the housing 220 and the housing 220 can be miniaturized.

The present invention is not limited to the above described and illustrated embodiments. For example, the following embodiments are also included in the technical scope of the present invention.

The substantially L-shaped intermediate terminal in which the inner and outer wire crimping portions are arranged at the opposite sides of the intermediate portion is illustrated in the above embodiment. However, the intermediate portion may be formed by bending the metal plate material substantially at a right angle and the arrangement of the inner and outer wire crimping portions does not matter according to the invention.

The inner wire 51 is connected to one end of the intermediate terminal and this inner wire 51 is connected to the female terminal 52 in the above embodiments. However, the inner wire 51 may be omitted and the female terminal 52 may be connected directly to one end of the intermediate terminal according to the invention.

The intermediate portion of the intermediate terminal is fixed to the housing in the above embodiments, but it may be insert molded to the housing in advance.

The inner and outer wires 51 and 70 are crimped respectively to the respective crimping portions of the intermediate terminal 53 in the above embodiments. However, they may be connected directly to the intermediate portion, for example, by ultrasonic welding, soldering, brazing or the like.

What is claimed is:

1. A connector connectable to a mating connector, comprising:

a housing connectable to a mating housing of the mating connector;

at least one terminal held in the housing and including a terminal connecting portion to be connected to a mating terminal provided in the mating connector and a conductor connecting portion connected to the terminal connecting portion;

a flexible outer wire pulled out to outside from the interior of the housing; and an inner conductive member configured to connect the conductor connecting portion and the outer wire in the housing, the inner conductive member including an inner wire and an intermediate terminal connected to the wire to form a bent intermediate portion by bending a conductive plate material, the intermediate portion being fixed to the housing.

2. The connector of claim 1, wherein the bent intermediate portion is formed by bending a conductive plate material substantially at a right angle.

3. The connector of claim 1, wherein the intermediate terminal includes an inner wire fixing portion arranged at one end of the intermediate portion and fixed to the inner wire and an outer wire fixing portion arranged at another end and fixed to the outer wire.

4. The connector of claim 3, wherein a part of the intermediate portion to be fixed to the housing is flush with the outer wire fixing portion.

5. The connector of claim 1, wherein the intermediate portion is fastened to the housing by a screw.

6. The connector of claim 1, wherein the intermediate portion is press-fit into the housing.

7. The connector of claim 1, wherein the housing is at least partly covered by a shield shell made of an electrically conductive plate or sheet material.

8. The connector of claim 7, wherein the shield shell comprises a first member and a second member assembled with each other, the second member being formed with at least one mounting portion to be mounted and fixed to a shield case.

9. The connector of claim 1, further comprising at least one mounting groove provided on a wire pullout portion in which the outer wire is pulled out from the housing, and at least one seal ring mounted in the mounting groove.

10. The connector of claim 1, further comprising an operation hole formed in correspondence with the terminal fixing portion in the housing and a cover removably mounted to the operation hole.

11. The connector of claim 10, wherein the cover includes a seal ring that closely contacts the inner peripheral surface of the operation hole to seal the interior of the housing.

12. The connector of claim 1, wherein at least one pair of intermediate terminals are provided and the respective intermediate terminals at least partly are accommodated in corresponding accommodation spaces, wherein the pair of adjacent intermediate terminals at least partly are partitioned by at least one partition wall partitioning a pair of adjacent accommodation spaces.

13. The connector of claim 1, wherein the intermediate portion is fixed to the housing in a fastening direction which substantially is perpendicular to a vibration transmission direction.

14. A connector connectable to a mating connector, comprising:

a housing connectable to a mating housing of the mating connector;

at least one terminal held in the housing and including a terminal connecting portion to be connected to a mating terminal provided in the mating connector and a conductor connecting portion connected to the terminal connecting portion;

a flexible outer wire pulled out to outside from the interior of the housing;

an inner conductive member configured to connect the conductor connecting portion and the outer wire in the housing and including a bent intermediate portion by bending a conductive plate material, the intermediate portion being fixed to the housing; and at least one pair of intermediate terminals at least partly accommodated in corresponding accommodation spaces and are partitioned by at least one partition wall partitioning a pair of adjacent accommodation spaces.

15. The connector of claim 14, wherein the bent intermediate portion is formed by bending a conductive plate material substantially at a right angle.

16. The connector of claim 14, wherein the inner conductive member includes an inner wire and an intermediate terminal connected to the inner wire to form the intermediate portion.

17. The connector of claim 16, wherein the intermediate terminal includes an inner wire fixing portion arranged at one end of the intermediate portion and fixed to the inner wire and an outer wire fixing portion arranged at another end and fixed to the outer wire.

18. The connector of claim 17, wherein a part of the intermediate portion to be fixed to the housing is flush with the outer wire fixing portion.

19. The connector of claim 14, wherein the intermediate portion is fastened to the housing by a screw.

20. The connector of claim 14, wherein the intermediate portion is press-fit into the housing.

* * * * *